US007708638B2

(12) United States Patent
Enzminger et al.

(10) Patent No.: US 7,708,638 B2
(45) Date of Patent: May 4, 2010

(54) METHOD, APPARATUS, AND PROGRAM PRODUCT FOR DETECTING MONEY LAUNDERING ACTIVITIES IN GAMING SYSTEMS

(75) Inventors: Joseph R. Enzminger, Austin, TX (US); Nimai Malle, Austin, TX (US); Clifton Lind, Austin, TX (US); Brendan O'Connor, Austin, TX (US); Rodney L. Willyard, Flower Mound, TX (US); Troy Jungmann, Austin, TX (US); Frank Roan, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 479 days.

(21) Appl. No.: 10/983,021

(22) Filed: Nov. 5, 2004

(65) Prior Publication Data

US 2005/0137016 A1 Jun. 23, 2005

Related U.S. Application Data

(60) Provisional application No. 60/530,329, filed on Dec. 17, 2003.

(51) Int. Cl.
*A63F 9/24* (2006.01)

(52) U.S. Cl. ..... 463/25; 463/29; 706/52

(58) Field of Classification Search ..... 463/25, 463/29, 40–42; 705/7, 16, 17, 21
See application file for complete search history.

(56) References Cited

U.S. PATENT DOCUMENTS 5,265,874 A * 11/1993 Dickinson et al. ..... 463/25
5,429,361 A * 7/1995 Raven et al. ..... 463/25
5,470,079 A * 11/1995 LeStrange et al. ..... 463/25
5,613,912 A * 3/1997 Slater ..... 463/25
5,759,103 A * 6/1998 Freels et al. ..... 463/42
5,836,817 A * 11/1998 Acres et al. ..... 463/26
6,071,190 A * 6/2000 Weiss et al. ..... 463/25
6,244,958 B1 * 6/2001 Acres ..... 463/26
6,257,981 B1 * 7/2001 Acres et al. ..... 463/26
6,267,671 B1 * 7/2001 Hogan ..... 463/25
6,280,328 B1 * 8/2001 Holch et al. ..... 463/42

(Continued)

OTHER PUBLICATIONS

Kilby et al., Jim, Casino Operations Management, 1998, John Wiley & Sons, Inc., pp. 59-78.*

*Primary Examiner*—Corbett B Coburn
(74) *Attorney, Agent, or Firm*—Russell D. Culbertson; Nathan H. Calvert; J P Cody

(57) ABSTRACT

A method for detecting potential money-laundering activities or other illegal activities in the use of a gaming accounting system includes collecting data regarding a player's activity in a gaming system. The gaming system activity data is collected in terms of a gaming activity network, that is, a series of linked activities or events, and/or objects associated with activities or events. In response to a predefined event such as a cash out or credit redemption transaction request initiated by the player, the method includes evaluating the collected data to identify potentially illegal or prohibited activity. In the event illegal activity is indicated, the method includes taking some corrective action such as producing an operator alert to the potential illegal activity.

19 Claims, 7 Drawing Sheets

U.S. PATENT DOCUMENTS

| | | | | |
|---|---|---|---|---|
| 6,511,377 | B1 * | 1/2003 | Weiss | 463/25 |
| 6,645,077 | B2 * | 11/2003 | Rowe | 463/42 |
| 6,722,985 | B2 * | 4/2004 | Criss-Puszkiewicz et al. | 463/29 |
| 6,733,385 | B1 * | 5/2004 | Enzminger et al. | 463/17 |
| 6,983,266 | B1 * | 1/2006 | Goldschmidt | 706/52 |
| 2002/0068624 | A1 * | 6/2002 | Ellis | 463/25 |
| 2002/0132666 | A1 * | 9/2002 | Lind et al. | 463/42 |
| 2003/0052454 | A1 | 3/2003 | Leen et al. | |
| 2003/0060247 | A1 * | 3/2003 | Goldberg et al. | 463/1 |
| 2003/0087691 | A1 * | 5/2003 | Kiely et al. | 463/25 |
| 2003/0087696 | A1 | 5/2003 | Soltys et al. | |
| 2003/0100371 | A1 | 5/2003 | Gatto et al. | |
| 2003/0100372 | A1 * | 5/2003 | Gatto et al. | 463/42 |
| 2003/0211885 | A1 | 11/2003 | Fujimoto | |
| 2004/0002386 | A1 * | 1/2004 | Wolfe et al. | 463/42 |
| 2004/0192434 | A1 * | 9/2004 | Walker et al. | 463/25 |
| 2005/0043086 | A1 * | 2/2005 | Schneider | 463/25 |

* cited by examiner

METHOD, APPARATUS, AND PROGRAM PRODUCT FOR DETECTING MONEY LAUNDERING ACTIVITIES IN GAMING SYSTEMS

CROSS-REFERENCE TO RELATED APPLICATION

The Applicants claim the benefit, under 35 U.S.C. §119(e), of U.S. Provisional Patent Application No. 60/530,329 filed Dec. 17, 2003 and entitled "METHOD, APPARATUS, AND PROGRAM PRODUCT FOR DETECTING MONEY LAUNDERING ACTIVITIES IN GAMING SYSTEMS." The entire content of this provisional application is incorporated herein by this reference.

TECHNICAL FIELD OF THE INVENTION

The present invention involves gaming systems in which players may convert cash to gaming system credit and then convert the gaming system credit back to cash or some other value. More particularly, the present invention relates to methods for detecting and preventing illegal activities such as money-laundering in a gaming system.

BACKGROUND OF THE INVENTION

Modern gaming systems may allow a player to insert cash into a machine or hand cash to a cashier and in return receive credit for the play of games in the system. This gaming system credit may take the form of an account accessible by the player or some physical cash equivalent such as a voucher or ticket. Once a player receives their gaming system credit, whether it be in the form of an account set up for the player or some tangible cash equivalent such as a voucher or ticket, the player can then use the gaming system credit to participate in games offered through the gaming system. In the course of participating in various games, the player can make wagers to reduce their remaining credit, and receive winnings to increase their credit. Ultimately, the player can request a cash out transaction to redeem their remaining gaming system credit for cash or other value.

These modern game accounting systems are very convenient for the players and for the gaming facility operators. In particular, the players need not carry large amounts of coins or tokens to participate in games. Also, the gaming facilities need not have the physical equipment and security required for coins and tokens. However, these modern game accounting systems can be used for illegal activities, particularly money laundering. Money laundering will be referred to in this disclosure generally as a process in which cash, commonly from illegal activities, is converted into some other form and then ultimately back into cash or some other asset in an effort to mask the original source of the funds and thus make illegal funds appear to be legitimately acquired assets.

The following scenario illustrates an illegitimate use of a gaming facility for money laundering. A person having some amount of ill-gotten cash to be laundered may first convert the cash amount to gaming system credit. The person may then convert the gaming system credit back into cash without making a significant amount of wagers in relation to the initial gaming system credit. At the time the player obtains cash for their gaming system credit, it may appear that the player has obtained legitimate winnings from their participation in the gaming system. However, the player has in fact not placed any significant portion of the ill-gotten funds at risk and has instead simply created a break in ownership to make it more difficult to track the ill-gotten funds.

SUMMARY OF THE INVENTION

The present invention includes a method for detecting potential money-laundering activities or other illegal activities in the use of a gaming accounting system so that appropriate action may be taken. A method embodying the principles of the invention includes collecting data regarding a player's activity in a gaming system. The gaming system activity data is collected in terms of a series of linked activities or events, and/or objects associated with activities or events. In response to a predefined event such as a cash out or credit redemption transaction request initiated by the player, the method includes evaluating the collected data to identify potentially illegal or prohibited activity. In the event illegal activity is indicated, the method may include taking some corrective action such as producing an operator alert to the potential illegal activity.

A series of linked gaming system activities, events, and/or objects associated with gaming system activities or events will be referred to herein as a "gaming activity network." Each linked gaming system activity, event, or object included in a gaming activity network will be referred to herein as an "activity node" in the respective network. Example activity nodes include (1) the production of a voucher or other cash equivalent object in a gaming system and (2) a gaming system access at a player station in the gaming system. A gaming activity network within the scope of the invention starts with an initial cash in node and ends with a cash out node. The nodes in the gaming activity network are linked by a representation of gaming system credit. In a preferred form of the invention, it is the cash out node that triggers an evaluation of data collected for the gaming activity network to identify potentially illegal activity.

A gaming system embodying the principles of the invention may be implemented in a gaming accounting system in which a player deposits cash and in return receives a cash equivalent object such as a printed or otherwise encoded voucher or ticket representing gaming system credits. The system includes a number of player stations which each act as a player interface through which a player may enter wagers, initiate game plays, and observe the results of the game plays. A preferred implementation of the system also includes an activity data collection device in communication with each player station. The activity data collection device collects data to define a characteristic for a gaming activity network for each respective player. In response to a predefined event, such as a request for a cash out or credit redemption transaction, a suitable evaluation processing device evaluates the data collected for the gaming activity network to identify potentially illegal or otherwise prohibited activity. For example, the evaluation processor may evaluate the relationship between a characteristic defined by the gaming activity network and the target characteristic to determine if the two characteristics bear a predefined relationship to each other. The evaluation processor also preferably produces an operator alert in the event the evaluation of gaming activity data indicates a potential illegal or otherwise prohibited activity.

The present method and gaming system are preferably implemented using a number of processing devices operating under the control of computer program code. The invention encompasses a program product for this computer code. In particular, a program product embodying the principles of the invention includes data collection program code, data evaluation program code, and alerting program code. The data collection program code directs the collection of data that will be used in performing the evaluation according to the invention. The data evaluating program code actually performs the evaluation of gaming activity network data, and the alerting program code responds to the identification of potentially illegal or prohibited activity by directing the production of an operator alert.

The present invention allows illegal activities such as money-laundering to be detected even where a player may use the gaming credit at several different gaming devices in an effort to mask the illegal activity. Gaming activity networks may also be linked or merged within the scope of the invention to detect illegal activity that may otherwise escape detection. These and other advantages and features of the present invention will be apparent from the more detailed description set out below in reference to the figures.

DESCRIPTION OF PREFERRED EMBODIMENTS

The present invention may be used with many different types of gaming systems. The following description of the present invention will be made in reference to a particular gaming system that will be described below with reference to FIGS. 1 through 4. However, it should be noted that the invention is not limited to any particular gaming system configuration. Rather, the invention may be used in connection with any gaming system in which there is a danger of players using the gaming system for money laundering and similar illegal activities.

Figure 1:
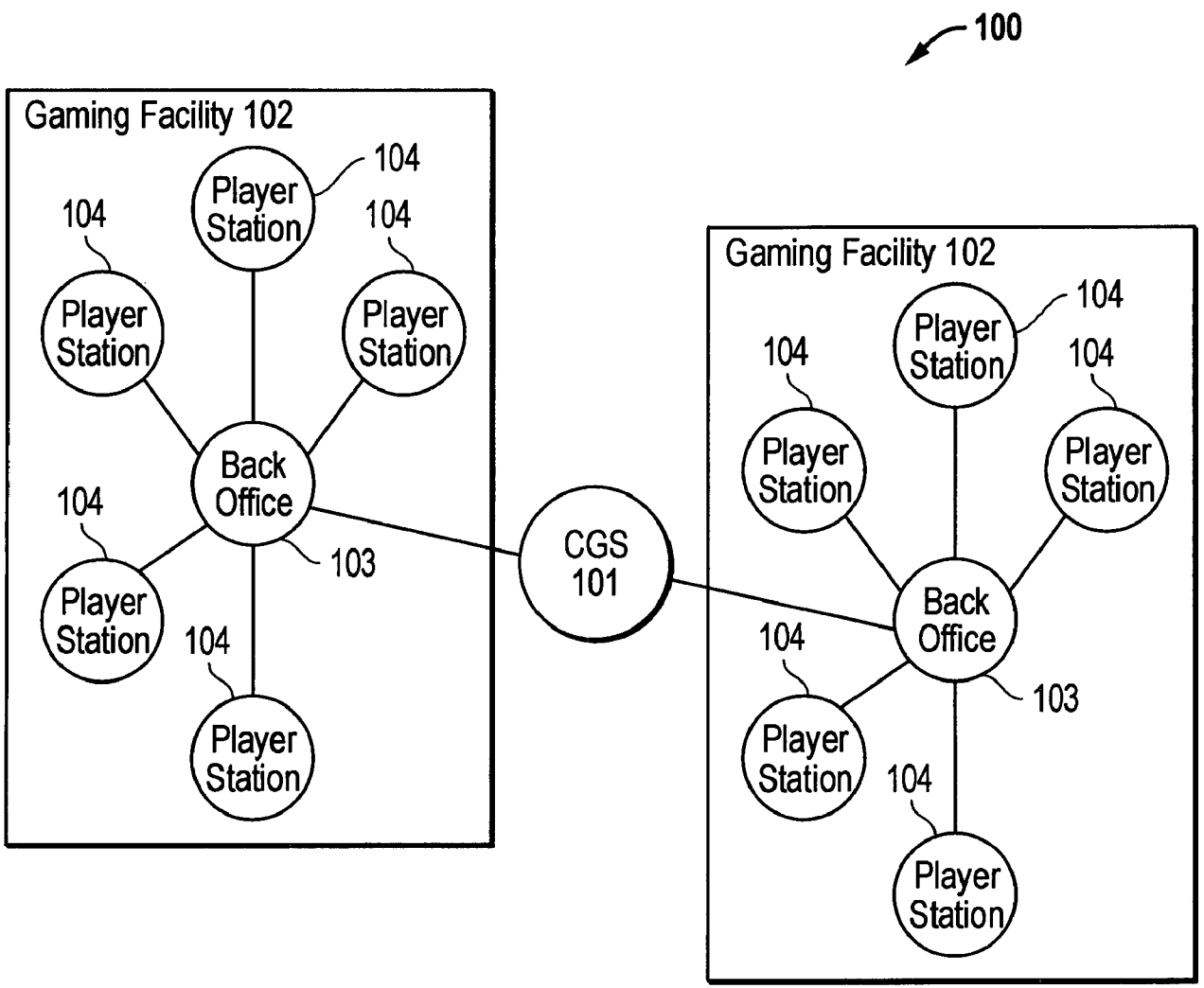
FIG. 1 is a high level diagrammatic representation of a gaming system in which the present invention may be implemented.

FIG. 1 shows a gaming system 100 including a central gaming system (CGS) 101 that cooperates with a number of other components to enable players to participate in wagering games. Each gaming site or facility 102 includes a back office system 103 and a number of gaming floor devices including player stations 104. Generally, player stations 104 each serve as a player interface to allow a player to participate in wagering games such as video lottery games, bingo games, video card games, and other wagering games. The back office system 103 at each gaming site or gaming facility 102 each includes one or more processing devices and other devices to cooperate with the local player stations 104 in allowing players to participate in the various wagering games. In particular, each back office system 103 includes processing devices programmed to facilitate game accounting, including tracking wagers made by the various local players and winnings obtained by the players to provide a current gaming system credit value for each player. The central gaming system 101 may include several different processing devices to facilitate system wide operations, accounting, and management.

It will be appreciated that the particular configuration of devices shown in FIG. 1 is shown only for purposes of example. This particular system configuration is well suited for systems providing video lottery games and bingo games. However, the invention is not limited to use with these types of games or this gaming system configuration. A gaming system in which the present invention may be used may omit the back office systems 103 so that the player stations 104 communicate directly with the central gaming system 101. In these configurations, the game accounting processes and processes making up the present invention as described below, may be performed by the central gaming system 101.

Figure 2:
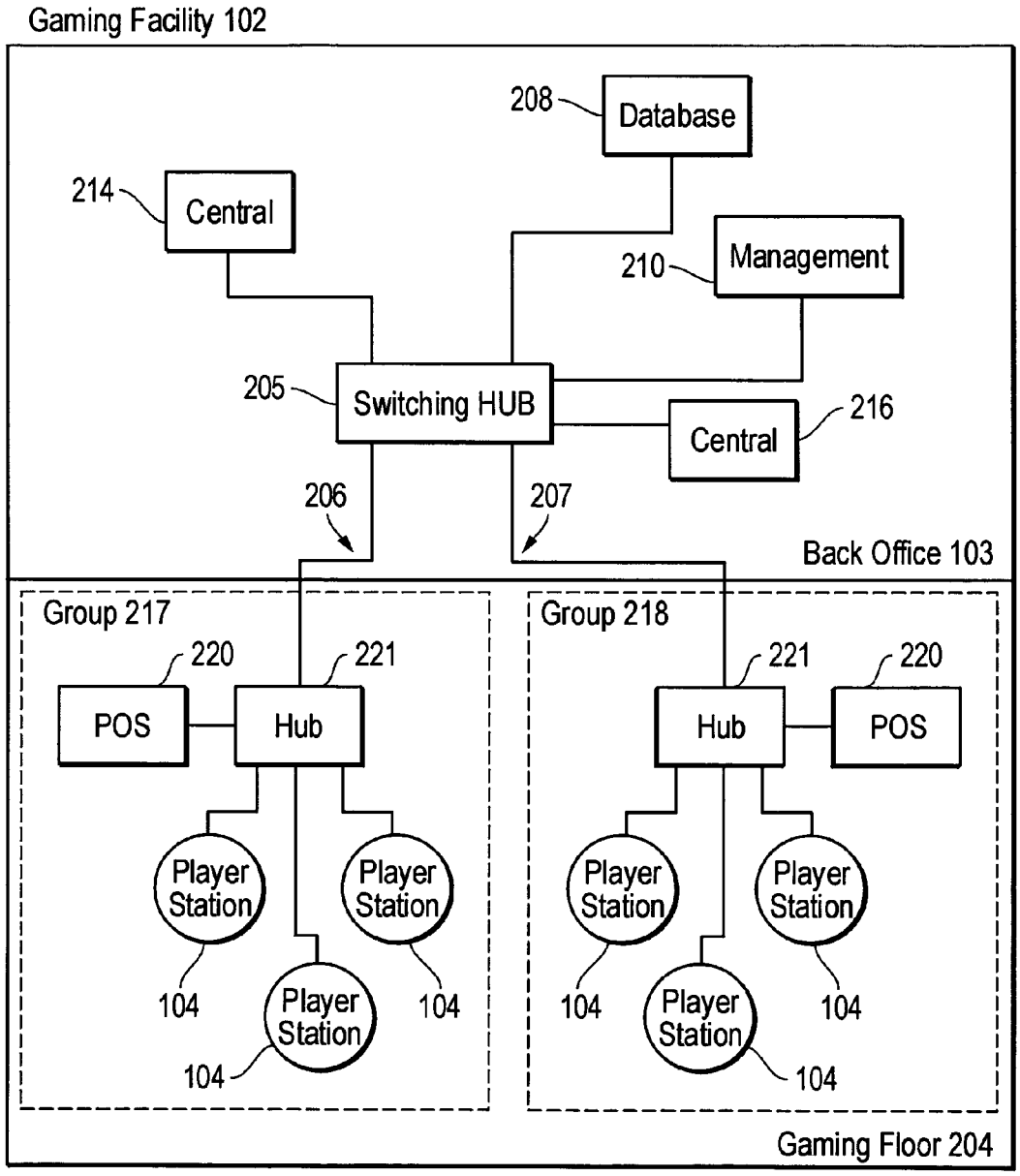
FIG. 2 is a diagrammatic representation of a gaming facility in the gaming system shown in FIG. 1.

FIG. 2 shows further details of a single gaming establishment or facility 102 including back office system 103 and player stations 104. As shown in FIG. 2, a secure communications arrangement facilitates communications between back office system 103 and a gaming floor system 204 in which player stations 104 are included. Communications lines 206 and 207 of the gaming facility system 102 extend from the back office system 103 to the gaming floor system 204 to facilitate communications between the two systems.

The back office system 103 includes a number of separate processing devices interconnected through a suitable communications arrangement. In the illustrated embodiment, back office system 103 comprises a local area network of individual processing devices and includes a switching hub (network switch) 205 to which each separate processing device connects. The two floor system communication links 206 and 207 also connect into switching hub 205.

The illustrated preferred form of back office system 103 shown in FIG. 2 includes a database computer 208, a management computer 210, and two separate central computers or processors 214 and 216. Each central computer 214 and 216 is programmed to communicate with database computer 208, and with a particular group of gaming floor devices. FIG. 2 shows two separate groups of gaming floor devices, group 217 and group 218, for purposes of example. The central computer 214 may be programmed to communicate with each of the gaming floor devices in group 217, while the central computer 216 may be programmed to communicate with each of the gaming floor devices in group 218.

In addition to communicating with the various gaming floor devices, each central computer 214 and 216 may cause information to be stored in the database computer 208. For example, the central computer 214 may receive game play requests together with wagers associated with the game play requests from player stations 104 in group 217. The central computer 214 may respond to a respective game play request by looking up an account credit value for the player in database computer 208 and creating an appropriate entry to modify the player's account credit value in the database computer 208.

Database computer 208, along with its associated data storage device or devices (such as one or more hard drives accessible to the database computer for example), serves as a data storage repository for storing all player records and system usage information in the illustrated implementation of back office 103. In a preferred embodiment of the present invention, the database computer 208 stores data regarding gaming system activity data for various players. This gaming system activity data in the form of gaming activity networks may be evaluated by suitable means to identify illegal or prohibited activity. In one form of the invention, the gaming activity data or gaming activity network for a given player is evaluated to define an activity network characteristic. One or more target characteristics may also be stored at the database computer 208 against which an activity network characteristic may be compared to identify potentially illegal activity. This evaluation process and others according to the present invention will be described below with reference to FIG. 5. Database computer 208 also preferably maintains all data necessary for game accounting including account balances and transaction records.

Numerous different database structures for use in database computer 208 will be appreciated by those of ordinary skill in database development and applications. Embodiments of the invention encompass any suitable database structure for maintaining the player information, the gaming activity network information, and other information that may be required in the operation of the gaming facility system 102, and the processes described below with reference to FIG. 5.

In the implementation shown in FIG. 2, management computer 210 operates under the control of management software to provide system reports including real-time reports and system usage and performance reports of interest to the system operators, managers, or regulators. The software executed at management computer 210 also may be used to schedule administrative functions required or helpful for database computer system 208. Management computer 210 may include a suitable display for providing a user interface and for displaying reports and other information.

Figure 3:
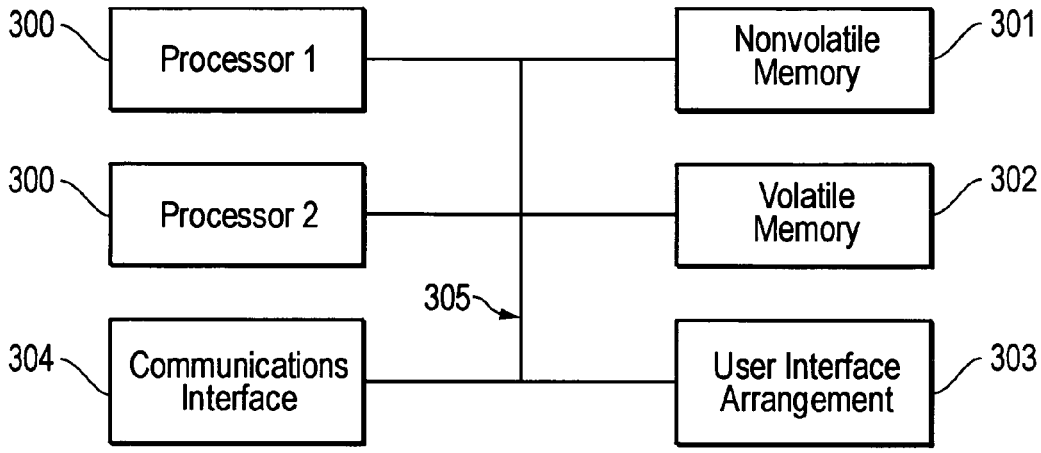
FIG. 3 is a diagrammatic representation of a computer system arrangement that may be used for the various processing devices included in the central gaming system and gaming facility systems shown in FIG. 1.

Each of the processing devices or computers included in central gaming system 101 and a respective back office system 103 may comprise a computer system such as the basic system shown in FIG. 3. The basic system may include one or more processors 300, nonvolatile memory 301, volatile memory 302, a user interface arrangement 303, and a communications interface 304, all connected to a system bus 305. It will be appreciated that user interface arrangement 303 may include a number of different devices such as a keyboard, a display, and a pointing device such as a mouse or trackball for example, although not shown in FIG. 3. Alternatively to the integrated user interface arrangement 303 shown in FIG. 3, a user interface for a respective processing device may be provided through a separate computer (not shown) in communication with the respective processing device.

Referring now to the gaming floor devices shown in FIG. 2, each group 217 and 218 includes a number of player stations 104 and a point-of-sale or cashier terminal (POS) 220, all connected to a local area network communications hub or switch 221. Although not shown in the figure, each group may also include one or more remote point-of-sale (RPOS) terminals, and one or more kiosks also connected to communications hub 221. The communications hub 221 of each gaming floor group is connected to hub 205 of the gaming facility system 102 through one of the communications lines 206 or 207.

Figure 4:
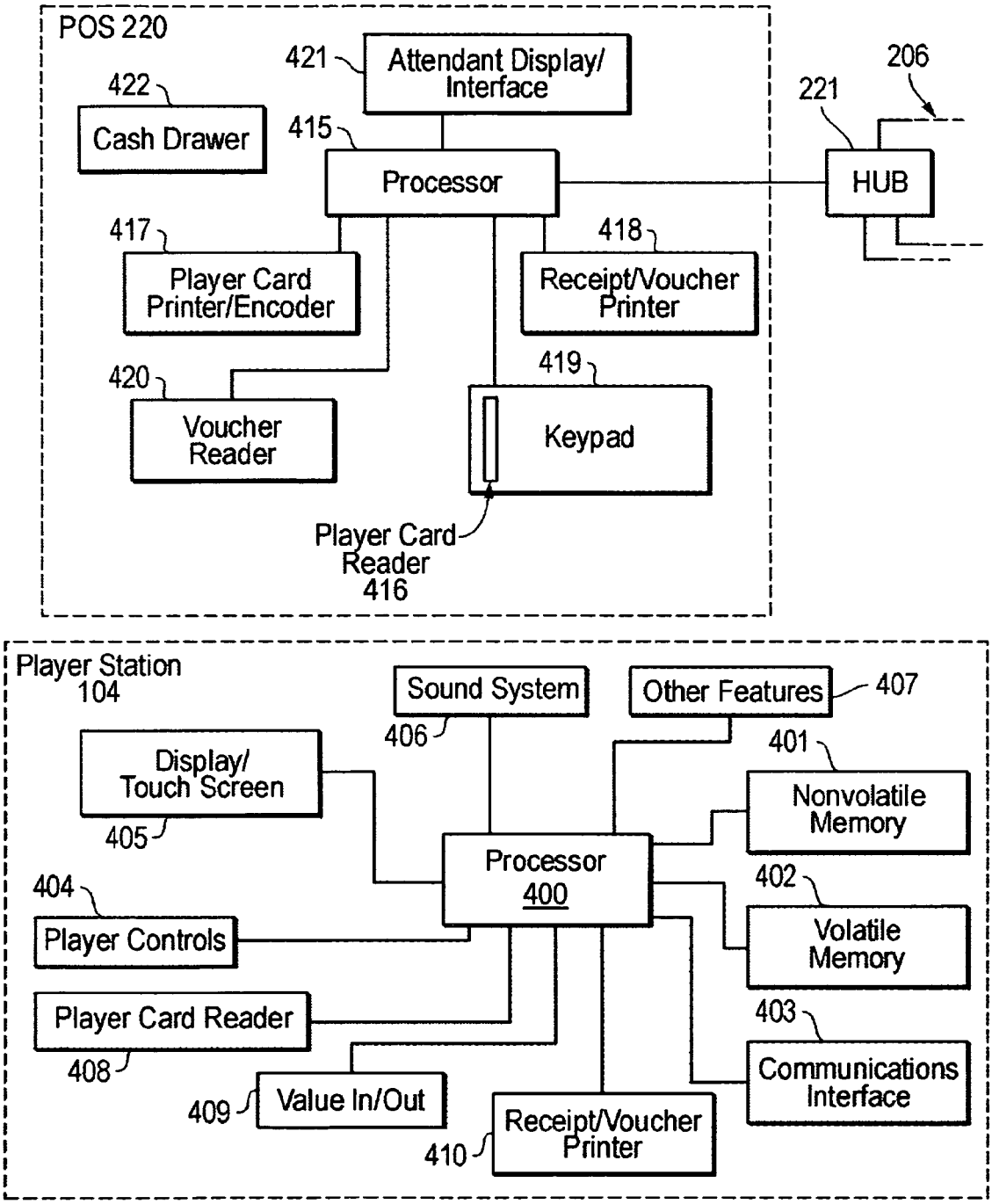
FIG. 4 is a diagrammatic representation of the point-of-sale terminal and player station that may be included in a gaming system implementing the present invention.

FIG. 4 shows further details of a player station 104 and POS 220 in the illustrated gaming system 100 of FIG. 1. The illustrated player station 104 includes a processor 400, nonvolatile memory 401, volatile memory 402, and a communications interface 403. The nonvolatile and volatile memories 401 and 402 store computer program code that may be executed by the processor 400 to cause the processor 400 to perform or direct the various functions provided by the player station 104. The communications interface 403 allows communications between the player station 104 and its respective back office system 103 and/or central gaming system 101, both of FIG. 1.

The player station 104 also includes a special user interface arrangement to facilitate player participation in the games offered through the gaming system 100 shown in FIG. 1, and to display results in an exciting and attractive format. This interface includes player controls 404, a display or touch screen display 405, a sound system 406, and perhaps other features 407 such as alarms or special displays or alerting devices. Each player station 104 also preferably includes a convenient system for allowing the player to input player-specific information and value for gaming credit, and for receiving wagers. For example, the player station 104 shown in FIG. 4 includes a player card reader 408 that is adapted to read player-specific information from a player card inserted into the reader. A player card may, for example, include player information or simply a player identifier encoded on a magnetic medium (mag stripe) associated with the card, or encoded on bar code, or a memory device associated with the player card. The illustrated player station 104 also includes a device 409 for receiving value from the player and a device 410 for issuing vouchers or receipts to the player. The device 409 may accept or present currency, vouchers, and/or tokens, for example. The device 410 may comprise a suitable printer for printing vouchers or receipts.

In addition to other functions that may be required in a given gaming system, the example POS terminal 220 shown in FIG. 4 enables a player to initiate a credit redemption transaction to obtain cash or other value for any credit remaining for the player after they have obtained gaming credit and participated in games offered through the player stations 104. Each POS terminal 220 may also allow a player to obtain gaming system credit in return for cash or other value, open a player account and/or obtain a player card for use in logging into player stations 104 during the course of the player's participation in games offered through the gaming system 100. POS terminal 220 comprises a computer system having a processor 415 and a player/cashier interface including a player card reader 416, player card printer/encoder 417, a receipt/voucher printer 418, a keypad 419, a voucher reader 420, and an attendant display/interface 421. POS terminal 220 may also include a cash drawer 422 which is accessible by a POS cashier or attendant. The processor 415 included in POS terminal 220 executes operational software to use the data input from the card reader 416, the keypad 419, the attendant display/interface 421, and/or the voucher reader 420, to communicate with the back office system 103 or the central gaming system 101 of FIG. 1, and to provide the appropriate outputs to the player card printer/encoder 417, the printer 418, and the attendant display/interface 421.

So as not to obscure the present invention in unnecessary detail, the following description of the various gaming floor devices such as the back office system 103, the central gaming system 101, and the gaming system 100 will focus on those aspects of the components pertinent to the present invention and will omit other aspects of the components. In particular, functions and elements of the gaming floor components involved in the actual play of games beyond game accounting will generally be omitted from the following disclosure. In some types of gaming systems, such as video lottery systems or bingo gaming systems, a great deal of communication and cooperation may be required between the central gaming system 101, the back office systems 103, and the player stations 104 simply to identify results of a given game play. At the other end of the spectrum, traditional video poker and reel-type games may require no cooperation between elements of the system to determine or identify the results of a game play, and may determine results according to some algorithm or other method at the respective player station 104.

It will be appreciated that the present invention is not in any way limited to use with any particular type of wagering games. Rather, the present illegal activity detecting system and method may be employed with any type of wagering games. Furthermore, the present system may be used with many different types of game accounting systems. For example, the invention may be used with a purely account-based game accounting system such as that described in U.S. patent publication 2002-0132666 A1, published Sep. 19, 2002, or systems that issue vouchers or tickets showing game credit.

In the course of participating in games offered through the gaming system 100 shown in FIG. 1 and its various components described in FIGS. 2, 3, and 4, a player generally must first obtain gaming system credit on the system 100. This may be accomplished in many different ways depending upon the particular implementation of the gaming system 100. For example, a player may purchase gaming system credit with cash given to an attendant at a POS such as the POS 220 shown in FIG. 2. This gaming system credit may be recorded in the system 100 in any suitable fashion. In particular, an anonymous gaming account or player account reflecting the player's gaming credit may be created and stored at the database computer 208. Alternatively to opening a player account or anonymous gaming account through a POS, a player may simply insert cash into a bill acceptor at a player station 104. This insertion of cash at a player station 104 may have the effect of opening an anonymous gaming account or conceivably a player account in the system 100 reflecting an amount of gaming system credit purchased with the inserted cash.

The above discussion distinguishes between anonymous gaming accounts and player accounts in the gaming system 100. For purposes of this disclosure and the accompanying claims an anonymous account (also referred to as a session account) is an account that is opened temporarily for tracking gaming credit between an initial purchase of gaming system credit and a final credit redemption transaction which reduces the account value to zero. Such an anonymous account may be maintained for gaming activity over any period of time and may remain as long as there is credit in the account. However, such an anonymous account need not be associated with any particular player. A player account in gaming system 100 is an account that identifies a particular player with player preference and other information specific to that player. Although information on wagering and payout history for the respective player may be maintained for various purposes in a player account, a player account may or may not provide an accounting mechanism to account for the player's play in a gaming system utilizing the invention. That is, a player account may be used only to collect usage and player preference data for a particular player, and one or more anonymous accounts may be used by the system to maintain a running account of player credit in the gaming system. Alternatively, a player account may be used to maintain a running account of player credit in the gaming system in lieu of or in addition to anonymous accounts. The present invention is applicable to gaming systems utilizing anonymous gaming accounts or player accounts, or both, for gaming credit accounting. It should also be noted that gaming system credit may be quantified in terms of cash value or in terms of arbitrarily assigned credit values. For example, one gaming system credit may be equivalent to five cents or twenty-five cents and converted to an actual cash value only when credits are redeemed for cash. The invention is not limited to any particular way to quantify gaming system credit.

Regardless of how the initial purchase of gaming system credit is effected in the gaming system 100, the central computer 214 or 216 or the database computer 208 of FIG. 2 may associate the initial gaming credit value with a gaming activity network identifier according to principles of the present invention. All transactions involving the gaming system credit may be identified with this gaming activity network identifier from the time the gaming credit account is opened to the time remaining credits are redeemed for cash or other value.

Once a player has obtained gaming system credit, the player may use any player station 104 to participate in games offered through the gaming system 100. To participate in a game, a player generally selects a wager applied against their gaming system credit and makes a game play request associated with the wager. These actions may be accomplished using various player controls at the respective player station 104 such as controls 404 and/or touch screen 405 shown in FIG. 4. In response to the wager and game play request, an appropriate element of the gaming system will determine or identify a result for the game play. This result will be communicated to the player through the player station 104 in some fashion and may be associated with a prize or winnings. From an accounting standpoint, the game play request reduces the player's gaming system credit by the amount of the wager associated with the request, and any winnings associated with a game play result increase the player's gaming system credit by the amount of the winnings. Thus, every wager and game play request represents at least one transaction on the player's gaming credit account, an initial debit in the amount of the wager, and potentially a second transaction comprising a credit in the amount of any winnings associated with the result of the game play.

Gaming system 100 may allow a player to make wagers and game play requests at one player station 104 and then go to another player station 104 to make additional wagers and game play requests. There are several game accounting arrangements in which the player's gaming system credits may follow the player from one player station 104 to another in a gaming session. For example, a purely account-based gaming system may allow a player to enter their account/ID information at one player station 104, terminate play at that player station 104, and then enter their account/ID information at another player station 104 to play games at that station. This process may be repeated a number of times for the player until the player finally redeems their remaining gaming system credits for cash or other value. As another example, a voucher based (anonymous account type or player account type) game accounting system may allow a player to obtain or purchase a voucher for gaming system credit at a point-of-sale or cashier station and the player may then insert that voucher at a player station 104 to give the player access to their credit for making wagers and game play requests at that player station 104. The voucher system may also allow the player to "cash out" at the player station 104 and receive a new voucher for their remaining gaming system credit from a suitable voucher printing or issuing device at the player station 104. The player may then insert this new voucher at any other player station 104 to gain access to the remaining gaming system credit for wagering at that new player station 104.

The manner in which the player's gaming credit account may be reflected in the gaming system 100 may vary widely within the scope of the present invention. Also, the specific manner in which a player interfaces with the gaming system to add gaming system credits and redeem credits may vary widely. Generally, the present invention is applicable to any gaming system in which a player purchases or otherwise obtains gaming system credits for cash or other value and then ultimately may redeem remaining gaming system credits for cash or other value.

A process according to the present invention may now be described with reference to FIG. 5. In the following description of FIG. 5, it will be appreciated that the references to the physical components are references to the diagrams in FIGS. 1, 2, 3, and 4 that show those components. The components, such as player stations 104, back office systems 103, and central gaming system 101 discussed with reference to the flow charts are generally not shown in the flow charts themselves but are shown particularly in FIGS. 1, 2, and 4.

Figure 5:
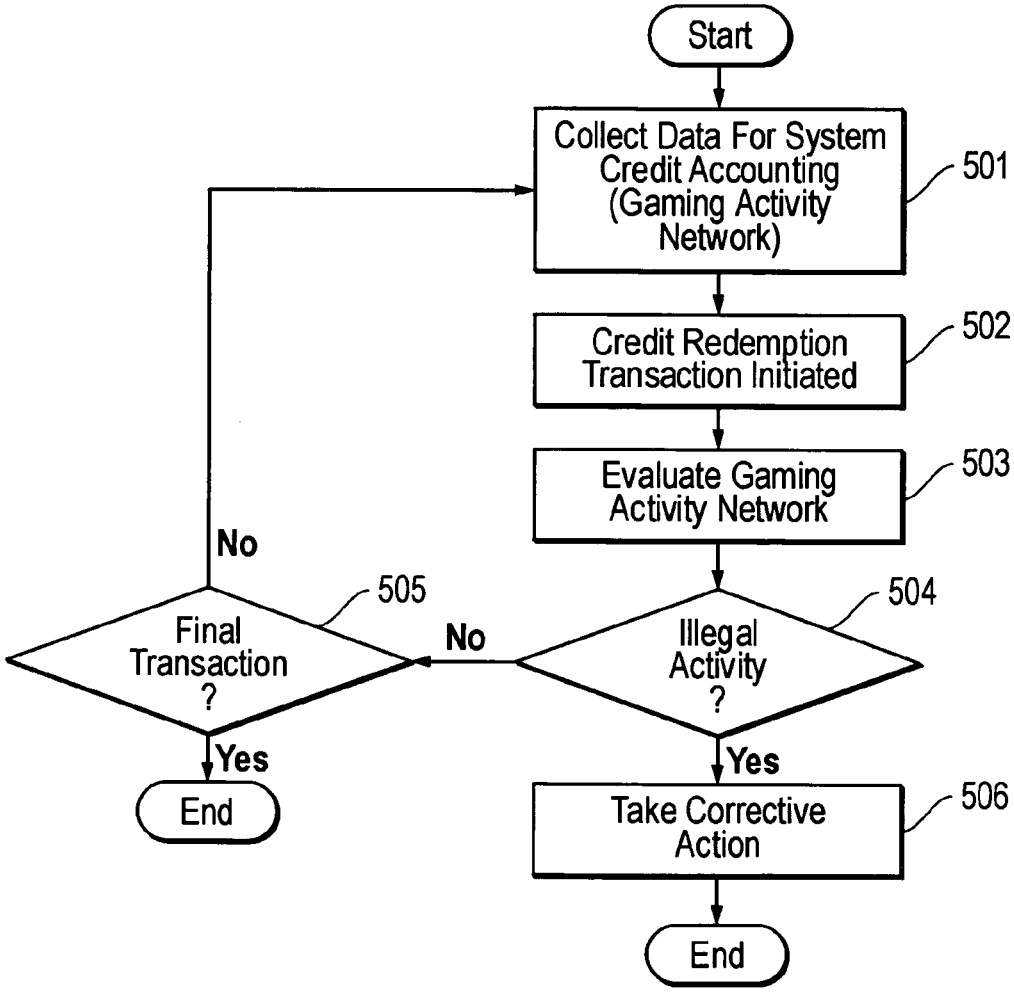
FIG. 5 is a diagrammatic representation showing process steps embodying the principles of the invention.

FIG. 5 shows a process performed for each gaming system credit account opened through a gaming system such as system 100 described above. Referring to FIG. 5, a method according to the present invention includes collecting data regarding player activity associated with a respective gaming system credit account. This step of collecting data is shown at process block 501 in FIG. 5, and includes collecting data that may be evaluated according to the invention to identify illegal or prohibited activity. In one preferred form of the invention, the step shown at block 501 includes collecting sufficient data to define at least one characteristic for a gaming activity network. Such a characteristic for a gaming activity network may be referred to as an "activity network characteristic." The data required to define an activity network characteristic under different variations of the present invention will be described further below.

As indicated at block 502, a player may initiate a credit redemption transaction in some suitable fashion through the gaming system 100. In particular, a player may initiate a credit redemption transaction at a POS 220 in the above described example gaming system. In response to a request for a credit redemption transaction, the process proceeds to conduct an evaluation as indicated at process block 503. In one preferred form of the invention, the evaluation at block 503 includes using an algorithm to evaluate a relationship between at least one activity network characteristic for the respective gaming activity network and a respective predefined target characteristic. This predefined target characteristic comprises a characteristic that is indicative of the illegal activity to be detected such as money-laundering activity. Preferably, the target characteristic is set to clearly distinguish between normal player participation in the gaming system and activity that does not fit normal patterns of play. Defining the respective target characteristic used in a system according to the present invention may be done using a historical analysis of normal gaming activity and prohibited activities to be detected.

The evaluation performed at process block 503 may be accomplished in a number of different ways within the scope of the invention. For the predefined target characteristic example, the target characteristic may comprise simply a value representing the ratio between a value for total gaming system credit added for the player's gaming activity network to the number of plays in the network. A high ratio between credit added and number of plays before a credit redemption transaction may indicate that the player has not opened their gaming account to participate in games, but merely to launder money through the system. In this example, the evaluation process includes comparing the actual calculated ratio of total gaming system credit to plays for the gaming activity network to the predefined target value to determine if the actual value calculated for the player is greater than the target value. The data collected for the activity network characteristic in this example is simply the sum of all credit added in the activity network and a running total of the number of plays made in the session. The target characteristic comprises a single parameter, the single predefined value of the ratio between the total gaming system credit added for the session to number of game plays in the session, and that single parameter is used as a threshold to indicate potential illegal activity. Other variations in the evaluation performed at process block 503 and different types of data that may be used in the evaluation step will be described further below.

The results of the evaluation step at process block 503 are used to determine the path followed from decision block 504. If the evaluation produces a negative result, meaning no illegal activity, then the present process proceeds to decision block 505 and then ends the particular gaming activity network if the credit redemption transaction is a final transaction to close out the credit account, that is to end the gaming activity network. Where the gaming credit account is not being closed out, the process loops back to collect additional data for the gaming activity network. If, however, the evaluation at process block 503 produces a positive result as indicated at decision block 504, the process continues on to produce or initiate some corrective action at process block 506. In particular, the present method may include producing a signal to alert the appropriate authorities to the potential illegal activity. The alert may be provided to the cashier at a POS 220 where the player is attempting to redeem game system credit for cash, to a gaming facility operator or manager, or to some government regulatory authority, or all of these entities. Additional or alternative corrective action may include locking the account such that the player may not redeem the gaming system credits for cash or other value pending an investigation by the appropriate authorities. The player may still be allowed to use the gaming system credit for game play even if the player's account is locked, that is, the player's gaming credit may not be redeemed for cash or other value.

The process shown in FIG. 5 indicates a distinct evaluation step after a request for a credit redemption transaction. However, this evaluation step shown at process block 503 need not occur only in response to a credit redemption transaction request initiated by the player. Rather, a gaming activity network may be routinely evaluated to identify or detect potential illegal or prohibited activity. The subject gaming activity network may be flagged as indicating potential illegal activity any time the evaluation indicates potential illegal activity. When a gaming activity network is flagged, the player may continue to make game play requests in the system and may ultimately use the system sufficiently so that the evaluation does not indicate potential illegal activity. At this point, the system may remove the flag from the respective activity network. In the simple example using a value for the ratio of total gaming system credit added to number of plays as the target characteristic, it will be appreciated that all gaming activity networks may initially be flagged for potential illegal activity. The flag would be removed once the player makes a sufficient number of plays in the activity network to reduce the ratio for their activity network below the predefined target value.

A number of the different values or characteristics may be used as gaming activity network characteristics according to the present invention. In addition to the total gaming system credit added and number of plays in the network described above, the present system may consider the elapsed time of the player's gaming activity network, the total amount wagered in the network or average amount wagered, for example. These individual characteristics may be combined in any fashion to produce some combined characteristic that may be used as the target characteristic for evaluation relative to a like calculated gaming activity network characteristic.

The invention also encompasses evaluating multiple individual gaming activity network characteristics against corresponding individual target characteristics and combining the evaluation results in some fashion to arrive at a final comparison result. Furthermore, the invention is not limited to a comparison algorithm as described above. Rather, the evaluation step shown at block 503 in FIG. 5 may be conducted using a suitable pattern matching technique matching patterns in the collected data with target data patterns associated with illegal activity. Neural network techniques may also be used to perform the evaluation indicated at process block 503.

Figure 6:
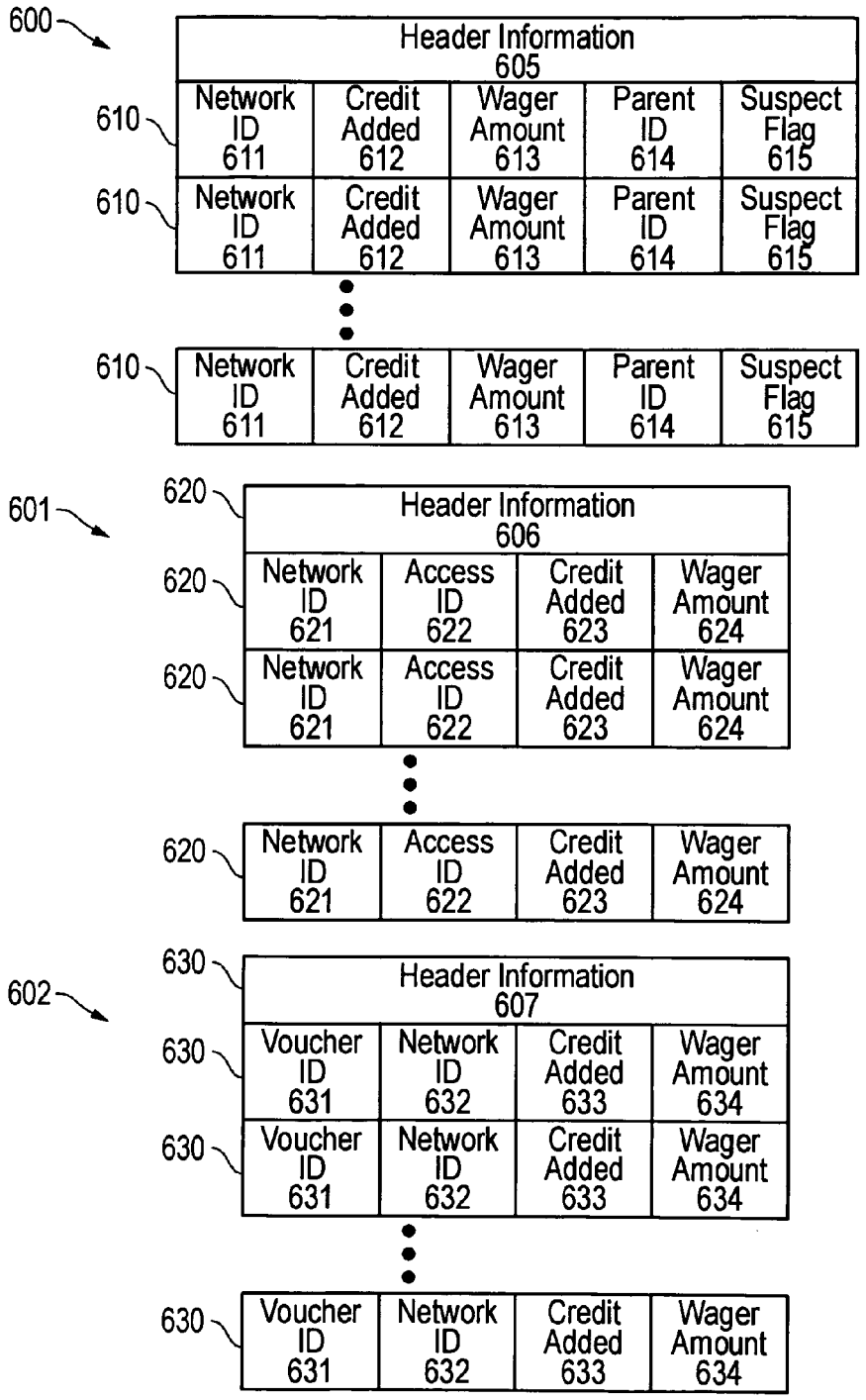
FIG. 6 is a representation of an arrangement of data tables that may be used to collect data used in the present invention.

FIG. 6 shows an example of an arrangement of data that may be collected for purposes of the present invention. This arrangement includes three different data tables and is particularly adapted for a game accounting system that receives cash from players to obtain gaming system credit and issues vouchers representative of the gaming system credit to be used at player stations or to redeem for cash or other value. Also, the example data tables shown in FIG. 6 are adapted to evaluate the ratio of total cash-in or value inserted for gaming system credit to the total amount put at risk or wagered in the gaming activity network to identify potentially illegal activity.

A first data comprises an activity network table 600 and contains information on all gaming activity networks at the respective gaming facility. Activity network table 600 includes header information 605 together with an entry for each individual gaming activity network being tracked for a particular gaming facility. The second type of data table comprises a station data table 601 and is maintained for each respective group of gaming activities at a player station 104 (FIGS. 1 and 2). Station data table 601 includes header information 606 and an entry 620 for each transaction in the respective group of gaming activities at a player station. The third type of data table shown in FIG. 6 comprises a voucher data table 602 that includes header information 607. Each entry 630 in voucher data table 602 is associated with a particular voucher produced in the gaming accounting system and represents gaming system credit.

Each entry 610 in the gaming activity network table 600 includes a gaming activity network identifier field 611 for an identifier unique to the given gaming activity network and fields for summary information collected for the gaming activity network. In this example table, each entry 610 includes a field 612 for total credit value added for the activity network or total cash in, a field 613 for a running total of the amount wagered or cash played in the activity network, a field 614 for an identifier of a parent gaming activity network, and a field 615 for a flag to indicate that the network has been determined to be suspect.

The example station table 601 shown in FIG. 6 includes an entry 620 for each related group of gaming activities at a player station such as station 104 in FIG. 1. Each entry 620 includes a field 621 for a gaming activity network identifier to identify a network in which gaming activities are included, a field 622 for an activity group or gaming system access identifier, a field 623 for total cash added or cash in, and a field 624 for the total amount wagered or cash played.

The example voucher table 602 shown in FIG. 6 includes an entry 630 for each voucher produced in the gaming system. Each entry 630 includes a field 631 for a voucher identifier, a field 632 for containing the gaming activity network identifier for the network with which the voucher is associated, a field 633 for a total cash in value, and a field 634 for a total cash played value.

These data tables are shown for purposes of example to help describe one preferred form of the invention. It will be appreciated that any suitable data structure may be maintained to collect the gaming activity data necessary to implement the present invention. In particular, the data required to implement the present invention may be combined with other data kept in tables with other data used in the course of operation of the particular gaming system. Furthermore, the specific fields shown in FIG. 6 are simply those useful in implementing an embodiment of the invention in which the ratio of cash in to cash played is evaluated to identify potential illegal activity. The present invention is by no means limited to this particular implementation used solely for purposes of example.

Figure 7:
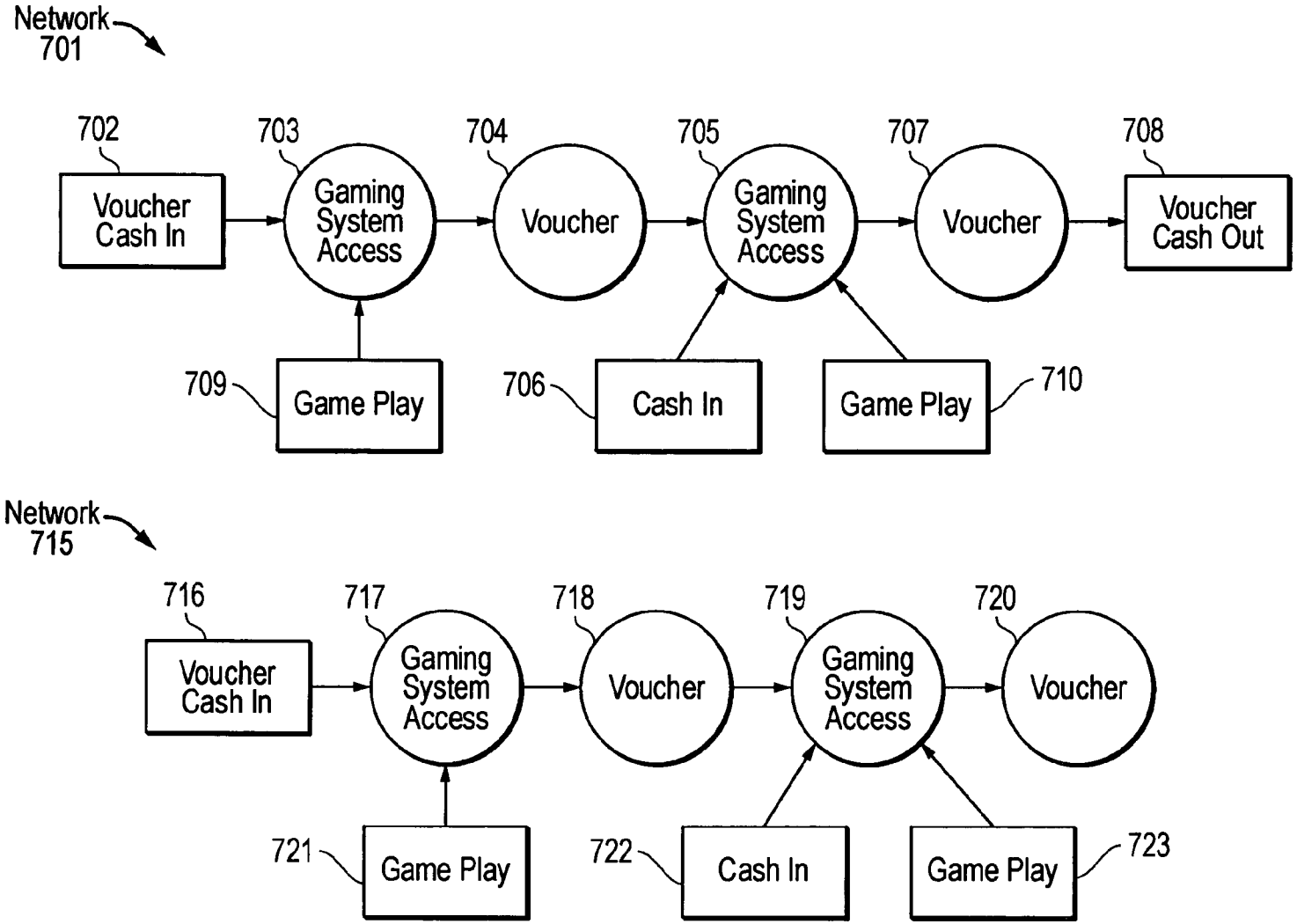
FIG. 7 is a representation of two different gaming activity networks according to the present invention.

FIG. 7 provides a graphic representation of two different gaming activity networks 701 and 715 according to principles of the present invention. These particular representations are for a system in which vouchers are issued for gaming system credit and where the vouchers may be used to transfer credit from one player station to the next. Also, FIG. 7 will be discussed in connection with data table activity using the example data tables shown in FIG. 6.

A first gaming network 701 starts with a cash deposit for a voucher at 702. The system defines a gaming activity network identifier for the voucher issued at 702 because the voucher is not related to an existing network. The player takes the voucher issued at 702 and uses it to conduct gaming activities at gaming system access block 703, including a game play 709. Ultimately, the player cashes out at the player station for a new voucher represented at circle 704. The player next takes the new voucher created at 704 and uses it in another series of gaming activities as indicated at gaming system access 705 at another player station. Series or gaming system access 705 includes a game play 710 and another cash deposit or cash in event 706. Finally, after cashing out for yet another new voucher at 707, the player takes the resulting voucher and makes a request to redeem the voucher for cash as indicated at 708. In the example associated with the tables shown in FIG. 6, the redemption request prompts the system to evaluate the network 701 for potential illegal activity. In the example arrangement, the system compares the ratio of cash in to cash played from the network table entry 610 for that particular network to some stored threshold value to determine if the network is associated with potentially illegal activity.

FIG. 7 also shows a separate gaming activity network 715 that is initiated with a player purchasing gaming system credit in the form of a voucher for cash at 716. The player next uses the voucher at a player station to conduct a series of gaming system activities represented by gaming system access block 717. The gaming system activities at gaming system access block 717 include a game play 721. After playing games through the player station, the player cashes out and obtains a voucher represented at 718. This voucher represents the remaining credit after play at gaming system access 717. The player uses the credit represented by the voucher at 718 to access gaming system credit through the same or another player station for another series of gaming system activities shown at gaming system access block 719. This gaming system access includes adding gaming system credits at 722 in exchange for cash or other value accepted at the player station, and another game play 723. Finally, the player cashes out from this second series of gaming activities at block 719 in gaming activity network 715 and obtains a voucher 720 representing the remaining gaming system credit in this gaming activity network. It will be noted that the voucher has not been redeemed for cash in the gaming activity network 715. However, the gaming system according to the invention may still be configured to evaluate the gaming activity network even without a cash out event.

The two gaming activity networks 701 and 715 in FIG. 7 graphically show how the various nodes of the network are connected. The gaming system access blocks and the vouchers used to access gaming system credit in the gaming system access blocks each represent nodes in the respective gaming activity network. In these examples, it is the voucher representing gaming system credit that links the nodes of the respective gaming activity network. The voucher issued at 702 connects the initial cash in transaction with the first gaming system access 703, the voucher 704 issued from gaming system access 703 links the credit remaining from that gaming system access to the gaming system access at 705, and the voucher 707 links the credit remaining from gaming system access 705 to the redemption request 708. Similarly, the voucher issued at 716 connects the initial cash in transaction with the first gaming system access 717, the voucher 718 issued from gaming system access 717 links the credit remaining from that gaming system access to the gaming system access at 719, and the voucher 720 will link the credit remaining from gaming system access 719 to the next player activity in the gaming system.

Using the example tables shown in FIG. 6, the vouchers from 702, 704, 707, 716, 718, and 720 would each be associated with a respective entry in the voucher table 602. The gaming system access blocks 703, 705, 717, and 719 would each be associated with a respective entry in gaming station table 601. Finally, each network 701 and 715 would be associated with a respective entry in the gaming activity network table 600.

The two gaming activity networks 701 and 715 in FIG. 7 may be used to describe how different gaming activity networks may themselves be linked and considered together to detect potential illegal activities. As indicated above, in the normal course of operation, vouchers produce the links to create gaming activity networks. In particular, a gaming activity network is started with the initial issuance of a voucher or other representation of gaming system credit for cash or other value such as at 702 and 716 in FIG. 7. However, some preferred forms of the invention allow a system operator to manually link separate gaming activity networks. Such a linking or merger of two different gaming activity networks merges the data for one network into the data for another. This merger is preferably accomplished on a field by field basis according to a suitable algorithm. For example, cash in value for the two networks would simply be added together to produce the new merged value for cash in value. Also, it should be noted that gaming activity networks may be linked by using a voucher in one network to produce gaming credit in a gaming system access that is part of another network. For example, the voucher at 720 could be used to add gaming system credit in gaming system access 705. In our example of data tables in FIG. 6, adding credit from voucher 720 would have the effect of adding the cash in and cash played values associated with that voucher into the running totals for gaming activity network 701. Where gaming activity networks are merged according to the invention, the merged data may be maintained in one of the original network entries in a table such as table 600 shown in FIG. 6. Alternatively, the invention may include generating a new entry such as an entry 610 in table 600 for the merged gaming activity network data. In either embodiment, where data from different gaming activity networks is merged or linked, the resulting data table entry may include a reference to any parent or related gaming activity network. This reference may be included in a field such as field 614 in the table 600 shown in FIG. 6. The parent ID field 614, could simply contain the gaming activity network identifier for the entry containing data which was merged into the respective entry.

The process steps described above with reference to FIG. 5 may be performed with any suitable processing device or devices included in the gaming system. In the example system 100 described above, central computers 214 and 216 of FIG. 2 may serve as data collection processing devices to direct the collection of data necessary to identify potential illegal activity and the actual data may be stored in data tables maintained at database computer 208. The central computers 214 and 216 may also perform the actual evaluation described above with reference to process block 503 in FIG. 5 and direct the production of the alerts or other corrective action in response to the detection of illegal activity.

It will also be appreciated that the process steps described above in FIG. 5 are preferably performed by a processing device under the control of operation software or program code. In particular, data collection program code executed at the appropriate processing device or devices such as the central computers 214 or 216 and database computer 208 directs the collection of data to be evaluated for potential illegal activity. Evaluation program code is executed at the appropriate processing device or devices to evaluate the collected data to identify potential illegal activity. Alerting program code responds to the identification of the potential illegal activity by directing the production of an operator alert and perhaps taking some other corrective action such as locking out the session account for cash redemptions. Both the evaluation program code and the alerting program code may be executed at the central computers 214 and 216 in the illustrated example system 100.

The above described preferred embodiments are intended to illustrate the principles of the invention, but not to limit the scope of the invention. Various other embodiments and modifications to these preferred embodiments may be made by those skilled in the art without departing from the scope of the present invention. For example, although a particular hardware arrangement is shown for purposes of describing the invention, it will be appreciated that numerous hardware arrangements are possible for implementing the present invention. In particular a single computer system may act both as a game server and provide data storage for the collected data necessary to implement the invention. Also, although the operational software-controlled process steps are described as occurring at certain processing elements in the system, the processing steps may be distributed in any suitable fashion over various data processing elements.

The invention claimed is:

1. A method including:

(a) on one of multiple computer devices in an electronic gaming system, maintaining gaming activity data for a first gaming activity network data structure for holding data regarding a first linked series of gaming system events and comprising at least:

(i) first data describing an initial cash in event at the beginning of the first linked series of events;

(ii) second data describing a first set of one or more gaming system access events each occurring after the initial cash in event and each being a money or voucher cash in event, or a game play event;

(iii) third data describing a voucher issue event occurring after the first set of gaming system access events and being associated with a first voucher issued for credit remaining after the first set of gaming system access events;

(iv) fourth data describing a voucher cash in event of the first voucher;

(v) fifth data describing a second set of one or more gaming system access events occurring after the cash in of the first voucher and each being a money or voucher cash in event, or a game play event; and (vi) sixth data describing a voucher issue event occurring after the second set of gaming system access events and being associated with a second voucher issued for credit remaining after the second set of gaming system access events;

the gaming activity data for the first gaming activity network data structure being associated with a first network data structure identifier which is unique to the first gaming activity network data structure, the gaming activity data for the first gaming activity network data structure including both a total amount wagered for the first gaming activity network data structure and a total credit value added or a total cash in for the first gaming activity network data structure, and also being sufficient to define an activity network characteristic for the first gaming activity network data structure wherein the gaming activity data for the first gaming activity network data structure is collected for a number of different player stations;

(b) on one of the multiple computer devices in the electronic gaming system, maintaining gaming activity data for a second gaming activity network data structure for holding data regarding a second series of linked gaming system events and comprising at least:

(i) seventh data describing an initial cash in event at the beginning of the second linked series of events;

(ii) eighth data describing a third set of one or more gaming system access events each occurring after the initial cash in event and each being a money or voucher cash in event, or a game play event; and (iii) ninth data describing a voucher issue event occurring after the third set of gaming system access events and being associated with a third voucher issued for credit remaining after the one or more gaming system access events;

the gaming activity data for the second gaming activity network data structure being associated with a second network data structure identifier which is unique to the second gaming activity network data structure, the gaming activity data for the second gaming activity network data structure including both a total amount wagered for the second gaming activity network data structure and a total credit value added or a total cash in for the second gaming activity network data structure, and also being sufficient to define an activity network characteristic for the second gaming activity network data structure;

(c) determining that the first and second gaming activity network data structures are related to each other;

(d) in response to determining such relationship, merging the gaming activity data for the first gaming activity network data structure with the gaming activity data for the second gaming activity network data structure to produce merged gaming activity data in one of the multiple computer devices;

(e) determining an activity network characteristic for the merged gaming activity data;

(f) determining if the activity network characteristic for the merged gaming activity data bears a predefined relationship to a target characteristic, the target characteristic being correlated to possible presence of an illegal gaming system activity to be detected; and (g) electronically producing an alert to a system operator in the event the activity network characteristic for the merged gaming activity data bears the predefined relationship to the target characteristic.

2. The method of claim 1 wherein the activity network characteristic for the merged gaming activity data includes a ratio between an amount wagered and an amount of cash made available for wagering for the merged gaming activity data.

3. The method of claim 1 wherein the activity network characteristic for the merged gaming activity data includes a ratio between an average amount wagered and an amount of cash made available for wagering for the merged gaming activity data.

4. The method of claim 1 further including the step of determining if the activity network characteristic for the first gaming activity network data structure bears the predefined relationship to the target characteristic a number of different times over a course of creating the first gaming activity network data structure and further including flagging a data table entry for the first gaming activity network data structure in the event the activity network characteristic for the first gaming activity network data structure bears the predefined relationship to the target characteristic.

5. The method of claim 1 wherein the step of determining if the activity network characteristic for the merged gaming activity data bears the predefined relationship to the target characteristic is performed in response to the occurrence of a predefined event.

6. The method of claim 5 wherein the predefined event is selected from a group of events consisting of a cash-out request, a credit redemption request, and a match between a predefined activity pattern and a pattern of activity in the merged gaming activity data.

7. A program product stored on at least one computer readable medium, the program product including:

(a) data collection program code for (i) maintaining gaming activity data for a first gaming activity network data structure for holding data regarding a first linked series gaming system events and comprising at least:

(1) first data describing an initial cash in event at the beginning of the first linked series of events;

(2) second data describing a first set of one or more gaming system access events each occurring after the initial cash in event and each being a money or voucher cash in event, or a game play event; and (3) third data describing a voucher issue event occurring after the first set of gaming system access events and being associated with a first voucher issued for credit remaining after the first set of gaming system access events;

(4) fourth data describing a voucher cash in event of the first voucher;

(5) fifth data describing a second set of one or more gaming system access events occurring after the cash in of the first voucher and each being a money or voucher cash in event, or a game play event; and (6) sixth data describing a voucher issue event occurring after the second set of gaming system access events and being associated with a second voucher issued for credit remaining after the second set of gaming system access events;

the gaming activity data for the first gaming activity network data structure being associated with a first network data structure identifier which is unique to the first gaming activity network data structure, and including both a total amount wagered for the first gaming activity network data structure and a total credit value added or a total cash in for the first gaming activity network data structure, and wherein the data collection program code directs the collection of gaming activity data for the first gaming activity network data structure from a number of different player stations; and for (ii) maintaining gaming activity data for a second gaming activity network data structure for holding data regarding a second series of linked gaming system events and comprising at least:

(1) seventh data describing an initial cash in event at the beginning of the second linked series of events;

(2) eighth data describing a third set of one or more gaming system access events each occurring after the initial cash in event and each being a money or voucher cash in event, or a game play event; and (3) ninth data describing a voucher issue event occurring after the third set of gaming system access events and being associated with a third voucher issued for credit remaining after the one or more gaming system access events;

the gaming activity data for the second gaming activity network data structure being associated with a second network data structure identifier which is unique to the second gaming activity network data structure, and including both a total amount wagered for the second gaming activity network data structure and a total credit value added or a total cash in for the second gaming activity network data structure;

(b) characteristic evaluating program code for (i) determining an activity network characteristic for merged gaming activity data, the merged gaming activity data being produced by merging the gaming activity data for the first gaming activity network data structure with the gaming activity data for the second gaming activity network data structure; and for (ii) determining if the activity network characteristic for the merged gaming activity data bears a predefined relationship to a target characteristic, the target characteristic being correlated to possible presence of an illegal gaming system activity to be detected; and (c) alerting program code for directing the production of an operator alert in the event the activity network characteristic for the merged gaming activity data bears the predefined relationship to the target characteristic.

8. The method of claim 2, in which the step of determining that the first and second gaming activity network data structures are related to each other further comprises a system operator linking the first gaming activity data structure to the second gaming activity data structures.

9. The method of claim 2, in which the step of determining that the first and second gaming activity network data structures are related to each other further comprises recognizing that the third voucher is used for a voucher cash in event in the first or second set of gaming system access events.

10. The method of claim 1, in which the first gaming activity network data structure is associated with a session account.

11. The method of claim 10, in which the session account is anonymous.

12. The method of claim 1, in which the merged gaming activity data includes a reference to the first or second gaming activity network data structure designating it as a parent gaming activity network data structure.

13. The program product of claim 7 wherein the characteristic evaluation program code is also for determining an activity network characteristic for the first gaming activity network data structure and further causes a data table entry for the first gaming activity network data structure to be flagged in the event the activity network characteristic for the first gaming activity network data structure bears the predefined relationship to the target characteristic.

14. The program product of claim 7 wherein determining if the activity network characteristic for the merged gaming activity data bears the predefined relationship to the target characteristic is performed in response to the occurrence of a predefined event.

15. The program product of claim 14 wherein the predefined event is selected from a group of events consisting of a cash-out request, a credit redemption request, and a match between a predefined activity pattern and a pattern of activity in the merged gaming activity data.

16. A gaming system including:

(a) a number of player stations at which a respective player may enter wagers and initiate game plays; and (b) a processing device in communication with each player station for (i) maintaining gaming activity data for a first gaming activity network data structure for holding data regarding a first linked series gaming system events and comprising at least:

(1) first data describing an initial cash in event at the beginning of the first linked series of events;

(2) second data describing a first set of one or more gaming system access events each occurring after the initial cash in event and each being a money or voucher cash in event, or a game play event; and (3) third data describing a voucher issue event occurring after the first set of gaming system access events and being associated with a first voucher issued for credit remaining after the first set of gaming system access events;

(4) fourth data describing a voucher cash in event of the first voucher;

(5) fifth data describing a second set of one or more gaming system access events occurring after the cash in of the first voucher and each being a money or voucher cash in event, or a game play event; and (6) sixth data describing a voucher issue event occurring after the second set of gaming system access events and being associated with a second voucher issued for credit remaining after the second set of gaming system access events;

the gaming activity data for the first gaming activity network data structure being associated with a first network data structure identifier which is unique to the first gaming activity network data structure, and including both a total amount wagered for the first gaming activity network data structure and a total credit value added or a total cash in for the first gaming activity network data structure, wherein the processing device collects the gaming activity data for the first gaming activity network data structure from more than one of the player stations; for (ii) maintaining gaming activity data for a second gaming activity network data structure data structure for holding data regarding a second series of linked gaming system events and comprising at least:

(1) seventh data describing an initial cash in event at the beginning of the second linked series of events;

(2) eighth data describing a third set of one or more gaming system access events each occurring after the initial cash in event and each being a money or voucher cash in event, or a game play event; and (3) ninth data describing a voucher issue event occurring after the third set of gaming system access events and being associated with a third voucher issued for credit remaining after the one or more gaming system access events;

the gaming activity data for the second gaming activity network data structure being associated with a second network data structure identifier which is unique to the second gaming activity network data structure, and including both a total amount wagered for the second gaming activity network data structure and a total credit value added or a total cash in for the second gaming activity network data structure; for (iii) merging the gaming activity data for the first gaming activity network data structure with the gaming activity data for the second gaming activity network data structure to produce merged gaming activity data; for (iv) determining an activity network characteristic for the merged gaming activity data; for (v) determining if the activity network characteristic for the merged gaming activity data bears a predefined relationship to a target characteristic, the target characteristic being correlated to possible presence of an illegal gaming system activity to be detected; and for (vi) producing an operator alert in the event the activity network characteristic for the merged gaming activity data bears the predefined relationship to the target characteristic.

17. The gaming system of claim 16 wherein the processing device is also for determining if an activity network characteristic for the first gaming activity network data structure bears the predefined relationship to the target characteristic a number of different times over a course of creating the first gaming activity network data structure and further including flagging a data table entry for the first gaming activity network data structure in the event the activity network characteristic for the first gaming activity network data structure bears the predefined relationship to the target characteristic.

18. The gaming system of claim 16 wherein determining if the activity network characteristic for the merged gaming activity data bears the predefined relationship to the target characteristic is performed in response to the occurrence of a predefined event.

19. The gaming system of claim 18 wherein the predefined event is selected from a group of events consisting of a cash-out request, a credit redemption request, and a match between a predefined activity pattern and a pattern of activity in the merged gaming activity data.

* * * * *